US006090764A

United States Patent [19]

Hees et al.

[11] Patent Number: 6,090,764

[45] **Date of Patent: *Jul. 18, 2000**

[54] WATER-BASED MANUAL DISHWASHING DETERGENTS COMPRISING GLYCEROL SULFATES

[75] Inventors: Udo Hees, Duisberg; Ansgar Behler, Bottrop, both of Germany

[73] Assignee: Henkel Kommanditgesellschaft auf Aktien, Duesseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,887

[22] PCT Filed: Oct. 20, 1995

[86] PCT No.: PCT/EP95/04124

§ 371 Date: Apr. 28, 1997

§ 102(e) Date: Apr. 28, 1997

[87] PCT Pub. No.: WO96/13567

PCT Pub. Date: May 9, 1996

[30] Foreign Application Priority Data

Oct. 28, 1994 [DE] Germany ..... 44 38 583

[51] Int. Cl.[7] ..... C11D 17/00

[52] U.S. Cl. ..... 510/235; 510/237; 510/426; 510/428; 510/470; 510/492; 134/25.1; 134/25.2

[58] Field of Search ..... 510/235, 237, 510/416, 417, 492, 424, 426, 470; 554/85, 90, 98, 96, 97; 558/20, 24, 26, 31, 32, 36; 134/25.1, 25.2

[56] References Cited

U.S. PATENT DOCUMENTS

| | | | |
|---|---|---|---|
| 2,979,521 | 4/1961 | Gray | 260/458 |
| 3,256,202 | 6/1966 | Weiss et al. | 252/138 |
| 4,024,078 | 5/1977 | Gilbert et al. | 252/551 |
| 4,692,271 | 9/1987 | Messenger et al. | 252/354 |
| 4,732,704 | 3/1988 | Biermann et al. | 252/548 |
| 4,753,754 | 6/1988 | Messenger et al. | 252/354 |
| 5,312,932 | 5/1994 | Behler et al. | 554/90 |
| 5,319,117 | 6/1994 | Fabry et al. | 554/98 |
| 5,322,957 | 6/1994 | Fabry et al. | 558/23 |
| 5,374,716 | 12/1994 | Biermann et al. | 536/18.6 |
| 5,576,425 | 11/1996 | Hill et al. | 536/18.6 |
| 5,578,560 | 11/1996 | Giesen et al. | 510/237 |
| 5,580,849 | 12/1996 | Dyet et al. | 510/427 |

FOREIGN PATENT DOCUMENTS

| | | |
|---|---|---|
| 0 216 301 | 4/1987 | European Pat. Off. . |
| 0 301 298 | 2/1989 | European Pat. Off. . |
| 40 38 478 | 6/1992 | Germany . |
| 90/03977 | 4/1990 | WIPO . |
| 91/05764 | 5/1991 | WIPO . |
| 94/09102 | 4/1994 | WIPO . |

*Primary Examiner*—Necholus Ogden
*Attorney, Agent, or Firm*—Wayne C. Jaeschke; Real J. Grandmaison; Glenn E.J. Murphy

[57] ABSTRACT

A process for increasing the solubility and surfactant content of a concentrated aqueous manual dishwashing detergent composition by adding to the composition a glycerol sulfate.

7 Claims, No Drawings

WATER-BASED MANUAL DISHWASHING DETERGENTS COMPRISING GLYCEROL SULFATES

BACKGROUND OF THE INVENTION

1. Field of the Invention

This invention relates to the use of glycerol sulfates in water-based manual dishwashing detergents which combine intensive foaming with high cleaning power.

2. Discussion of Related Art

Liquid cleaning formulations generally consist of aqueous solutions of synthetic anionic and/or nonionic surfactants and typical additives. They are used in particular for cleaning hard surfaces, for example glass, ceramic materials, plastics, painted and polished surfaces. An important application for liquid cleaning formulations is manual dishwashing. Dishwashing is normally carried out in highly dilute liquors at slightly elevated temperatures of around 35 to 45° C. Consumers generally consider the cleaning performance of a dishwashing detergent to be better, the more intensively and the longer the cleaning liquor foams. Because the hands come into contact with the cleaning liquor over a prolonged period, the skin compatibility of the detergent is another factor of considerable significance in manual dishwashing. For these reasons, the choice of the components for and composition of a manual dishwashing detergent involve other factors than the same choice for liquid cleaners for other hard surfaces.

In the recent past, increasing efforts have been made to increase the surfactant content of manual dishwashing detergents in order to obtain so-called concentrates. The development of concentrates generally involves the problem that the high surfactant content required cannot be achieved on account of solubility limits.

The problem addressed by the present invention was to provide detergent formulations, more particularly water-based manual dishwashing detergents, having a high overall surfactant content.

DESCRIPTION OF THE INVENTION

According to the invention, this problem has been solved by the use of glycerol sulfates as solubilizers. Glycerol sulfates are suitable solubilizers in particular for total surfactant contents of more than 25% by weight and preferably more than 33% by weight, based on the manual dishwashing detergent as a whole.

Trisulfated glycerol is particularly suitable for the purposes of the invention, although monosulfated or disulfated glycerol and mixtures thereof are also suitable solubilizers. The glycerol sulfate may be prepared, for example, by reaction of glycerol with gaseous $SO_3$. A synthesis procedure is disclosed in the Examples.

Particularly suitable surfactants are $Cr_{6-22}$ alkyl sulfates and/or $Cr_{6-22}$ alkyl ether sulfates and/or $C_{9-13}$ alkyl benzene sulfonates.

Accordingly, the present invention also relates to the use of glycerol sulfates in water-based manual dishwashing detergents containing $C_{6-22}$ alkyl sulfates and/or $C_{6-22}$ alkyl ether sulfates and/or $C_{9-13}$ alkyl benzene sulfonates.

Fatty alkyl sulfates (FAS) which may be used for the purposes of the invention correspond to formula II:

$$R^2—O—SO_3X \quad (II)$$

in which $R^2$ is a saturated or unsaturated $C_{6-22}$ alkyl group and X is an alkali metal or alkaline earth metal.

These substances are known chemical compounds which may be obtained by sulfation of fatty alcohols. Typical examples are the sulfates of caproic alcohol, caprylic alcohol, capric alcohol, lauryl alcohol, myristyl alcohol, cetyl alcohol, palmitoleyl alcohol, stearyl alcohol, oleyl alcohol, elaidyl alcohol, petroselinyl alcohol, arachyl alcohol, gadoleyl alcohol, behenyl alcohol and erucyl alcohol and technical mixtures thereof. Sulfates of technical $C_{12/14}$ or $C_{12/18}$ coconut fatty alcohol cuts in the form of their sodium or magnesium salts are preferably used.

Fatty alkyl ether sulfates (FAES) which may be used for the purposes of the invention correspond to formula III:

$$R^3O—(CH_2CH_2O)_n—SO_3X \quad (III)$$

in which $R^3$ is a saturated or unsaturated $C_{6-22}$ alkyl group, n is a number of 1 to 10 and X is an alkali metal or alkaline earth metal.

These substances are also known chemical compounds which may be obtained by sulfation of fatty alcohol polyglycol ethers. Narrow-range FAES (NRE=narrow range ethoxylates) which are described, for example, in International patent application WO 91/05764 and in the article by D. L. Smith in J. Am. Oil Chem. Soc. 68, 629 (1991) may also be used.

Typical examples are the sulfation products of adducts of 1 to 10 moles of ethylene oxide (conventional or narrow homolog distribution) with 1 mole of caproic alcohol, caprylic alcohol, capric alcohol, lauryl alcohol, myristyl alcohol, cetyl alcohol, palmitoleyl alcohol, stearyl alcohol, oleyl alcohol, elaidyl alcohol, petroselinyl alcohol, arachyl alcohol, gadoleyl alcohol, behenyl alcohol and erucyl alcohol and technical mixtures thereof. Sulfates of adducts of 2 to 7 moles of ethylene oxide with saturated coconut fatty alcohols containing 12 to 18 carbon atoms in the form of their sodium, potassium and/or magnesium salts are preferred. For example, fatty alcohol ether sulfates derived from corresponding fatty alcohol polyglycol ethers which, in turn, have been prepared in the presence of calcined or, more particularly, hydrophobicized hydrotalcite and which therefore have a particularly advantageous narrow homolog distribution may be used.

$C_{9-13}$ alkyl benzene sulfonates which may be used for the purposes of the invention are the products marketed, for example, under the trade names Marlon (Hüls) and Witconate (Witco).

Surfactant mixtures of the type mentioned above which additionally contain a $C_{6-22}$ alkyl glycoside are particularly preferred.

Accordingly, the present invention also relates to water-based detergent compositions, more particularly manual dishwashing detergents, containing a) 0.2% by weight to 10% by weight and preferably 1% by weight to 5% by weight of a glycerol sulfate, b) 1% by weight to 50% by weight and preferably 5% by weight to 45% by weight of a $C_{6-22}$ alkyl sulfate, $C_{6-22}$ alkyl ether sulfate, $C_{9-13}$ alkyl benzene sulfonate or a mixture of the above-mentioned surfactants and c) 1% by weight to 20% by weight and preferably 2% by weight to 10% by weight, based on the detergent as a whole, of an alkyl glycoside corresponding to formula IV:

$$R^4O[G]_x \quad (IV)$$

in which $R^4$ is a saturated or unsaturated $C_{6-22}$ alkyl group, G is a glycose unit and x is a number of 1 to 10.

Water-based detergent compositions according to the invention are, for example, foam baths, hair shampoos and, in particular, manual dishwashing detergents. The total surfactant content of these compositions is preferably above 25% by weight and, more preferably, above 33% by weight, based on the detergent composition as a whole.

Alkyl glycosides (APG) are known substances which may be obtained by the relevant methods of preparative organic chemistry. EP-A1 0 301 298 and WO 90/3977 are cited here as representative of the extensive literature available on the subject. Alkyl glycosides correspond to formula IV:

$$R^4O[G]_x \qquad \text{(IV)}$$

in which $R^4$ is a linear or branched, saturated or unsaturated $C_{6-22}$ alkyl group, [G] is a glycose unit and x is a number of 1 to 10.

The index x in general formula IV indicates the degree of oligomerization (DP degree), i.e. the distribution of mono- and oligoglycosides, and is a number of 1 to 10. Whereas x in a given compound must always be an integer and, above all, may assume a value of 1 to 6, the value x for a certain alkyl glycoside is an analytically determined calculated quantity which is generally a broken number. Alkyl glycosides with an average degree of oligomerization x of 1.1 to 3.0 are preferably used. Alkyl glycosides with a degree of oligomerization below 1.7 and, more particularly, between 1.2 and 1.6 are preferred from the performance point of view. Preferred glycoses are glucose and xylose.

The alkyl or alkenyl group $R^4$ may be derived from primary alcohols containing from 6 to 22 and preferably 12 to 18 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis.

The alkyl or alkenyl radical $R^4$ is preferably derived from lauryl alcohol, myristyl alcohol, cetyl alcohol, palmitoleyl alcohol, stearyl alcohol, isostearyl alcohol or oleyl alcohol. Elaidyl alcohol, petroselinyl alcohol, arachyl alcohol, gadoleyl alcohol, behenyl alcohol, erucyl alcohol and technical mixtures thereof are also mentioned.

Other anionic surfactants optionally present in the detergent compositions according to the invention are, for example, alkanesulfonates containing 10 to 20 and preferably 12 to 18 carbon atoms in the alkyl group and olefin sulfonates containing 12 to 16 and preferably 12 to 14 carbon atoms in the n-alkyl group. These other anionic surfactants may be present in quantities of up to 50% by weight, based on the detergent composition as a whole.

Soaps, i.e. alkali metal or ammonium salts or saturated or unsaturated $C_{6-22}$ fatty acids, are preferably not present in the detergent compositions according to the invention on account of their foam-damping properties.

However, the feature "not present" is not intended to rule out the presence of very small quantities of soaps. Quantities of up to 2% by weight, based on the detergent composition as a whole, are tolerable in accordance with the invention.

Other surfactants optionally present in the detergent compositions according to the invention are amphoteric surfactants and nonionic surfactants.

Suitable amphoteric surfactants are betaine compounds corresponding to the following formula:

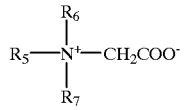

in which $R_5$ is a $C_{8-25}$ and preferably $C_{10-21}$ alkyl group optionally interrupted by hetero atoms or groups of hetero atoms and $R_6$ and $R_7$, which may be the same or different, represent $C_{1-3}$ alkyl groups. $C_{10-18}$ alkyl dimethyl carboxymethyl betaine and $C_{11-17}$ alkyl amidopropyl dimethyl carboxymethyl betaine are preferred.

If other nonionic surfactants—apart from alkyl glucosides corresponding to formula IV—are used, fatty acid alkanolamides, for example $C_{12/18}$ fatty acid monoethanolamide, or products of the addition of 4 to 20 and preferably 4 to 10 moles of alkylene oxide, preferably ethylene oxide, to $C_{10-20}$ and preferably $C_{12-18}$ alkanols and also products of the addition of ethylene oxide to polypropylene glycols, which are known under the name of Pluronics®, and products of the addition of 1 to 7 moles of ethylene oxide to $C_{12-18}$ alkanols reacted with 1 to 5 moles of propylene oxide are suitable. Fatty alkyl amine oxides are also suitable.

The solvents optionally added are low molecular weight alkanols containing 1 to 4 carbon atoms in the molecule, preferably ethanol and isopropanol. Other solubilizers which may optionally be used, for example for dyes and perfume oils, are for example alkanolamines, polyols, such as ethylene glycol, propylene glycol, glycerol and alkyl benzene sulfonates containing 1 to 3 carbon atoms in the alkyl group.

Preferred thickeners include urea and ammonium chloride which may also be used in combination with one another. Suitable preservatives are, for example, sodium benzoate, formaldehyde and sodium sulfite. The detergent compositions according to the invention may also contain typical disinfectants.

The detergent compositions according to the invention preferably have a pH value of 5.0 to 7.5.

The detergent compositions according to the invention described in the following Examples were obtained by stirring the individual components together in any order and leaving the mixture standing until all bubbles had disappeared.

EXAMPLES

I. Production Example

Sulfonation of Glycerol 300 g (3.26 moles) of glycerol were reacted with sulfur trioxide at 50° C. in a continuous falling-film reactor (length 120 cm, cross-section 1 cm, educt throughput 600 g/h) equipped with a jacket cooling system and a lateral inlet for $SO_3$ gas. The molar ratio of $SO_3$ to glycerol was 3.0:1. The sulfur trioxide was driven out by heating from a corresponding quantity of 65% by weight oleum, diluted with nitrogen to a concentration of 5% by volume and contacted with the glycerol film through a nozzle. The crude sulfonation product was then neutralized to pH 6.5 to 8 with 37% by weight sodium hydroxide solution.

A glycerol sulfate thus prepared was used for the following Application Examples.

II. Application Examples

Example 1

Manual dishwashing detergent concentrate:

20% $C_{12/14}$ fatty alcohol ether (3EO) sulfate Na salt

10% $C_{12/14}$ fatty alcohol sulfate Na salt

6% $C_{12/14}$ cocoalkyl oligoglucoside (50% by weight aqueous paste, Henkel KGaA)

4% coconut fatty acid amidopropyl betaine

4% glycerol sulfate

10% ethanol balance to 100% water

Example 2

Manual dishwashing detergent concentrate:

18% $C_{12/14}$ fatty alcohol ether (3EO) sulfate Mg salt

11% $C_{9-13}$ alkyl benzene sulfonate Na salt

6% $C_{12/14}$ fatty alcohol sulfate Mg salt

3% coconut fatty acid amidopropyl betaine

3% glycerol sulfate

5% ethanol balance to 100% water

Example 3

Manual dishwashing detergent concentrate:

16% $C_{12/14}$ fatty alcohol ether (3EO) sulfate Na salt

8% $C_{12/14}$ fatty alcohol sulfate Mg salt

8% coconut fatty acid monoethanolamide

2% coconut fatty acid amidopropyl betaine

2% lauryl dimethyl amine oxide

4% glycerol sulfate

5% ethanol balance to 100% water

Example 4

Manual dishwashing detergent concentrate:

25% $C_{12/14}$ fatty alcohol sulfate Na salt

12% $C_{12/14}$ fatty alcohol+10 EO

6% cocoamidopropyl betaine

2% coconut fatty acid monoethanolamide

4% glycerol sulfate

10% ethanol balance to 100% water

Example 5

Manual dishwashing detergent concentrate:

25% $C_{12/14}$ fatty alcohol sulfate Na salt

12% $C_{10}$ fatty alcohol+1 PO+8 EO

6% cocoamidopropyl betaine

2% coconut fatty acid monoethanolamide

4% glycerol sulfate

10% ethanol balance to 100% water

Example 6

Manual dishwashing detergent concentrate

25% $C_{9-13}$ alkyl benzene sulfonate Na salt

9% $C_{12/14}$ FAEOS Na salt

8% APG 600

4% glycerol sulfate

5% ethanol balance to 100% water

What is claimed is:

1. The process of increasing the solubility and surfactant content of a concentrated aqueous manual dishwashing detergent composition containing at least 25% by weight of an anionic surfactant comprising adding to said composition from 0.2 to 10% by weight of a glycerol sulfate selected from the group consisting of monosulfated glycerol, disulfated glycerol, trisulfated glycerol, and mixtures thereof, formed by sulfating glycerol, all weights being based on the weight of said composition.

2. A process as in claim 1 wherein said anionic surfactant is selected from the group consisting of $C_6$–$C_{22}$ alkyl sulfates, $C_6$–$C_{22}$ alkyl ether sulfates, and $C_9C_{13}$ alkyl benzene sulfonates.

3. A process as in claim 1 wherein said detergent composition further contains an amphoteric or nonionic surfactant.

4. A process as in claim 3 wherein said nonionic surfactant comprises a $C_6$–$C_{22}$ alkyl glycoside.

5. A process as in claim 1 wherein said detergent composition comprises a) 0.2% to 10% by weight of said glycerol sulfate, b) 5% to 45% by weight of a surfactant selected from the group consisting of a $C_6$–$C_{22}$ alkyl sulfate, a $C_6$–$C_{22}$ alkyl ether sulfate, a $C_9$–$C_{13}$ alkyl benzene sulfonate, and mixtures thereof, c) 1% to 20% by weight of an alkyl glycoside corresponding to formula IV $$R^4O[G]_x \quad \text{(IV)}$$

in which $R^4$ is a saturated or unsaturated $C_6$–$C_{22}$ alkyl group, G is a glycose unit and x is a number of 1 to 10, and d) the balance, water.

6. A concentrated detergent composition comprising:

a) 0.2% to 10% by weight of a glycerol sulfate selected from the group consisting of monosulfated glycerol, disulfated glycerol, trisulfated glycerol, and mixtures thereof, formed by sulfating glycerol, b) at least 25% by weight of an anionic surfactant selected from the group consisting of a $C_6$–$C_{22}$ alkyl sulfate, a $C_6$–$C_{13}$ alkyl benzene sulfonate, and mixtures thereof, and c) the balance, water, all weights being based on the weight of the composition.

7. A detergent composition as in claim 6 further containing from 1% to 20% by weight of an alkyl glycoside corresponding to formula IV $$R^4O[G]_x \quad \text{(IV)}$$

in which $R^4$ is a saturated or unsaturated $C_6$–$C_{22}$ alkyl group, G is a glycose unit and x is a number of 1 to 10.

* * * * *